US007220903B1

(12) United States Patent
Bronen

(10) Patent No.: US 7,220,903 B1
(45) Date of Patent: May 22, 2007

(54) REED MOUNT FOR WOODWIND MOUTHPIECE

(76) Inventor: Andrew Bronen, 21 Edgewood Commons, Miliwood, NY (US) 10546

( * ) Notice: Subject to any disclaimer, the term of this patent is extended or adjusted under 35 U.S.C. 154(b) by 259 days.

(21) Appl. No.: 11/068,403

(22) Filed: Feb. 28, 2005

(51) Int. Cl.
*G10D 9/02* (2006.01)

(52) U.S. Cl. ..... 84/383 R

(58) Field of Classification Search ..... 84/383 R, 84/380 R, 385 A
See application file for complete search history.

(56) References Cited

U.S. PATENT DOCUMENTS

| | | | |
|---|---|---|---|
| 147,202 | A | 2/1874 | Vogel |
| 477,661 | A | 6/1892 | Janes |
| 488,828 | A | 12/1892 | Mudge |
| 555,561 | A | 3/1896 | Cadwallader |
| 1,506,364 | A | 8/1924 | Chiron et al. |
| 1,535,537 | A | 4/1925 | Majeski |
| 1,615,549 | A | 1/1927 | Miller |
| 1,667,836 | A | 5/1928 | Brockman |
| 1,776,566 | A | 9/1930 | Newton et al. |
| 1,779,522 | A | 10/1930 | Widmayer |
| 1,789,639 | A | 1/1931 | Selmer |
| 2,106,016 | A | 1/1938 | Prescott |
| D112,783 | S | 1/1939 | Noble |
| D119,602 | S | 3/1940 | Verville |
| 2,268,641 | A | 1/1942 | Brilhart |
| 2,287,529 | A | 6/1942 | Maccaferri |
| 2,342,836 | A | 2/1944 | Brilhart |
| 2,375,934 | A | 5/1945 | Lucas |
| 2,467,921 | A | 5/1947 | Werner |
| 2,492,366 | A | 12/1949 | Ohnhaus |
| 2,669,897 | A | 2/1954 | Topor |
| 3,183,760 | A | 5/1965 | Michel |
| 3,202,032 | A | 8/1965 | Strathmann |
| 3,564,965 | A | 2/1971 | Carlini |
| 3,905,268 | A | 9/1975 | Gamble |
| 4,056,997 | A | 11/1977 | Rovner |
| 4,145,949 | A | 3/1979 | Kilian |
| 4,172,482 | A | 10/1979 | Gomez |
| 4,212,223 | A | 7/1980 | Runyon |
| 4,337,683 | A | 7/1982 | Backus |
| 4,345,503 | A | 8/1982 | Runyon |
| 4,355,560 | A | 10/1982 | Shaffer |
| 4,449,439 | A | 5/1984 | Wells |
| 4,572,257 | A | 2/1986 | Laker |
| 4,644,649 | A | 2/1987 | Seaman et al. |
| 4,796,507 | A | 1/1989 | Stibal |
| 4,941,385 | A | 7/1990 | Johnson |
| 4,991,483 | A | 2/1991 | Petit |
| 5,000,073 | A | 3/1991 | Hite |

(Continued)

*Primary Examiner*—Gary F. Paumen
(74) *Attorney, Agent, or Firm*—Milde & Hoffberg, LLP

(57) ABSTRACT

A mouthpiece assembly for a woodwind musical instrument comprising a mouthpiece body defining an air conduit extending therethrough, a reed placement surface defined on the mouthpiece body adjacent said air conduit, a pair of extensions, integral to and extending from the body of the mouthpiece on opposed sides of the reed placement surface with respect to an opening of the air conduit, and a mechanism for selectively applying a compressive force to a reed placed over the opening of the air conduit, with respect to the body of the mouthpiece, generating to a tensile force applied to each of said pair of extensions, to selectively retain the reed in position. The present design provides advantageous acoustic properties for the mouthpiece, and further provides for advantageous placement of an electronic pickup for receiving the output of the instrument.

12 Claims, 6 Drawing Sheets

U.S. PATENT DOCUMENTS

| | | | | |
|---|---|---|---|---|
| 5,018,425 | A | 5/1991 | Rovner | |
| 5,033,350 | A | 7/1991 | Galper | |
| 5,105,701 | A | 4/1992 | Hall et al. | |
| 5,289,752 | A | 3/1994 | Barbaglia | |
| 5,398,582 | A | 3/1995 | Smith | |
| 5,456,152 | A | 10/1995 | Cusack et al. | |
| 5,479,842 | A | 1/1996 | Ostermeyer | |
| 5,648,623 | A | 7/1997 | Silverstein et al. | |
| 6,020,545 | A | 2/2000 | Consoli | |
| 6,501,010 | B2 | 12/2002 | Sullivan | |
| 6,673,992 | B1 | 1/2004 | Runyon | |
| 6,747,198 | B1 * | 6/2004 | Sullivan | 84/383 R |

* cited by examiner

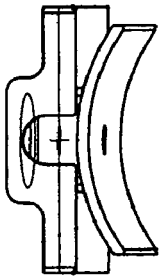
Fig. 1M
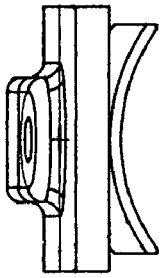
Fig. 1L
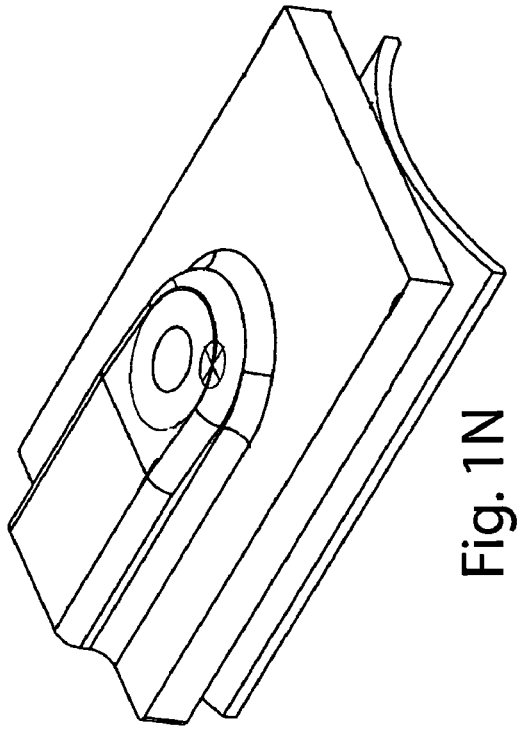
Fig. 1N
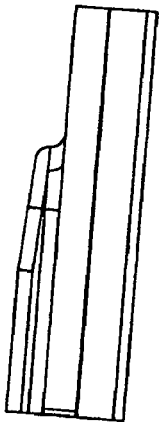
Fig. 1I
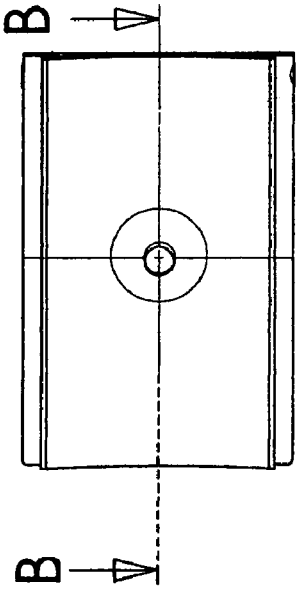
Fig. 1J
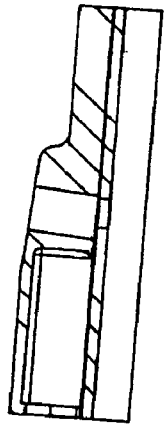
B-B Fig. 1K

REED MOUNT FOR WOODWIND MOUTHPIECE

FIELD OF THE INVENTION

The present invention relates to the field of woodwind mouthpieces, and more particularly, to an improved system and method for mounting a reed to a woodwind mouthpiece.

BACKGROUND OF THE INVENTION

Traditional woodwind instrument mouthpieces comprise a body, a ligature, and a reed. The body, which is typically made of plastic, rubber or metal, has a smooth upper surface which is intended to rest against the upper lip and teeth, and a lower surface which is intended to mount the reed, which has a small gap from the body, allowing flowing air to vibrate the reed and produce a tone, whose frequency is generally controlled by the remainder of the instrument. The player may also control the reed by applying pressure with the lip and teeth.

Various configurations have been designed for mouthpieces and reeds for musical instruments, usually woodwind instruments, such as shown in U.S. Pat. No. 147,202 patented Feb. 3, 1874 to C. W. Vogel on "Reed-Organs"; and U.S. Pat. No. 477,661 patented Jun. 28, 1892 to H. Janes on a "Vibrator For Reed Musical Instruments"; and U.S. Pat. No. 488,828 patented Dec. 27, 1892 to C. S. Mudge on a "Musical Instrument"; and U.S. Pat. No. 555,561 patented Mar. 3, 1896 to G. R. Cadwallader on a "Reed Supporter For Clarinets"; and U.S. Pat. No. 1,506,364 patented Aug. 26, 1924 to H. M, Chiron et al on a "Reed For Saxophone Or Clarinet Mouth Pieces"; and U.S. Pat. No. 1,535,537 patented Apr. 28, 1925 to W. Majeski an "Adjustable Reed In Wind Instruments"; and U.S. Pat. No. 1,615,549 patented Jan. 25, 1927 to B. Miller on a "Mouthpiece For Reed Instruments"; and U.S. Pat. No. 1,667,836 patented May 1, 1928 to F. Brockman, Jr. on a "Reed For Musical Wind Instruments"; and U.S. Pat. No. 1,776,566 patented Sep. 23, 1930 to H. B. Newton et al on a "Mouth Reed For Musical Instruments"; and U.S. Pat. No. 1,779,522 patented Oct. 28, 1930 to C. O. Widmayer on a "Reed For Clarinets And Saxophones"; and U.S. Pat. No. 1,789,639 patented Feb. 20, 1929 to Selmer on a "Mouthpiece for Wind Instruments"; and U.S. Pat. No. 2,106,016 patented Jan. 18, 1938 to H. T. Prescott on a "Reed For Musical Instruments"; and U.S. Design Pat. No. Des. 112,783 patented Jan. 3, 1939 to O. C. Noble and assigned to Tygart Valley Glass Company on a "Jar"; and U.S. Design Pat. No. Des. 119,602 patented Mar. 26, 1940 to A. A. Verville on a "Reed For A Musical Instrument"; and U.S. Pat. No. 2,268,641 patented Jan. 6, 1942 to A. Brilhart on a "Reed For Musical Instruments"; and U.S. Pat. No. 2,287,529 patented Jun. 23, 1942 to M. Maccaferri on a "Reed Of Cane, Plastic, Or Any Other Material For Clarinets, Saxophones, And Like Musical Instruments"; and U.S. Pat. No. 2,342,836 patented Feb. 29, 1944 to A. Brilhart and assigned to Arnold Brilhart Ltd. on a "Reed For Musical Instruments"; and U.S. Pat. No. 2,375,934 patented May 15, 1945 on a "Reed"; and U.S. Pat. No. 2,467,921 patented May 28, 1947 to Werner on a "Saxophone Mouthpiece"; and U.S. Pat. No. 2,492,366 patented Dec. 27, 1949 to A. L. Ohnhaus on a "Wood-Wind Reed"; and U.S. Pat. No. 2,669,897 patented Feb. 23, 1954 to J. Topor on a "Reed For Musical Instruments"; and U.S. Pat. No. 3,183,760 patented May 18, 1965 to A. Michel on "Reeds For Application In Musical Instruments Particularly In Electronic Musical Instruments"; and U.S. Pat. No. 3,202,032 patented Aug. 24, 1965 to A. R. Strathmann on a "Mouthpiece For Saxophones And Clarinets"; and U.S. Pat. No. 3,564,965 patented Feb. 23, 1971 to J. A. Carlini on a "Ligature For Reed Musical Instrument"; and U.S. Pat. No. 3,905,268 patented Sep. 16, 1975 to J. G. Gamble on "Reeds For Saxophones, Clarinets And Other Woodwinds"; and U.S. Pat. No. 4,056,997 patented Nov. 8, 1977 to P. L. Rovner on a "Reed Holding Device For Musical Instruments"; and U.S. Pat. No. 4,145,949 patented Mar. 27, 1979 to F. A. Kilian on a "Musical Reed"; and U.S. Pat. No. 4,172,482 patented Oct. 30, 1979 to H. M. Gomez on a "Method And Apparatus For Adjusting Single Reeds For Musical Instruments"; and U.S. Pat. No. 4,212,223 patented Jul. 15, 1980 to Runyon on a "Mouthpiece for Woodwind Musical Instruments"; and U.S. Pat. No. 4,337,683 patented Jul. 6, 1982 to J. G. Backus on a "Synthetic Woodwind Instrument Reed And Method For Its Manufacture"; and U.S. Pat. No. 4,345,503 patented Aug. 24, 1982 to Runyon on an "Interchangeable Tone Chamber"; and U.S. Pat. No. 4,355,560 patented Oct. 26, 1982 to D. W. Shaffer on a "Reed Construction"; and U.S. Pat. No. 4,449,439 patented May 22, 1984 to F. E. Wells on a "Mouthpiece For Woodwind Instruments"; and U.S. Pat. No. 4,572,257 patented Feb. 25, 1986 to E. B. Laker on an "Apparatus For Profiling Reeds For Double-Reed Musical Instruments"; and U.S. Pat. No. 4,644,649 patented Feb. 24, 1987 to R. C. Seaman et al on an "Apparatus For Trimming Reeds Of Musical Instruments"; and U.S. Pat. No. 4,796,507 patented Jan. 10, 1989 to T. L. Stibal on a "Reed Holding Device"; and U.S. Pat. No. 4,941,385 patented Jul. 17, 1990 to C. O. Johnson on a "Tone Plate And Clamping Device For A Musical Instrument Mouthpiece"; and U.S. Pat. No. 4,991,483 patented Feb. 12, 1991 to R. Petit on a "Mouthpiece For Wind Instrument, And Corresponding Ligature And Mouthpiece Cover"; and U.S. Pat. No. 5,000,073 patented Mar. 19, 1991 to D. Hite on a "Construction For Supporting A Reed Upon The Mouthpiece Of A Musical Wind Instrument And Method Of Fabricating The Same"; and U.S. Pat. No. 5,018,425 patented to P. L. Rovner on May 28, 1991 on a "Mouthpiece System For Woodwind Instruments"; and U.S. Pat. No. 5,033,350 patented Jul. 23, 1991 to A. Galper on a "Single Reed Mouthpiece"; and U.S. Pat. No. 5,105,701 patented Apr. 21, 1992 to J. Hall et al on a Clarinet Mouthpiece"; and U.S. Pat. No. 5,289,752 patented Mar. 1, 1994 to E. Barbaglia on a "Device For Fastening The Reed On The Mouthpiece of Wind Instruments"; and U.S. Pat. No. 5,398,582 patented Mar. 21, 1995 to G. T. Smith and assigned to Mobile Music, Inc., Gary Smith and Joseph Stefano on a "Wire Clamping Ligature For Use With A Single Reed Mouthpiece For A Musical Instrument"; and U.S. Pat. No. 5,456,152 patented Oct. 10, 1995 to Cusack et al. on a "Mouthpiece for Woodwind Instruments Having a Raised Lay Portion"; and U.S. Pat. No. 5,479,842 patented Jan. 2, 1996 to W. H. Ostermeyer on "Flavored Musical Instrument Reeds"; and U.S. Pat. No. 5,648,623 patented Jul. 15, 1997 to Silverstein et al., on a "Ligature of Woodwind Instruments"; and U.S. Pat. No. 6,020,545 patented Feb. 1, 2000 to J. J. Consoli on a "Ligature For The Mouthpiece Of A Woodwind Musical Instrument"; and U.S. Pat. No. 6,501,010 patented Dec. 31, 2002 to Sullivan on a "Reed and Mouthpiece Assembly"; and U.S. Pat. No. 6,673,992 patented Jan. 6, 2004 to Runyon on a "Saxophone Mouthpiece", each of which is expressly incorporated herein by reference.

In reeded woodwind instruments, such as clarinets and saxophones, a moistened reed beveled is utilized during the performance thereof. Such reeds are typically installed and removed before and after each playing session and also during performances if they become unusable for any reason. The flow of air from the player's mouth causes the reed to resonate, at a principal frequency determined by the remainder of the instrument.

The reed must be properly aligned with respect to the mouthpiece in such a manner that proper tone is produced by the instrument. This alignment is typically provided by a sight or touch alignment.

The reed is typically fixed to the body by a ligature, which encircles the reed and body. Known ligatures have one or more thumbscrews which tighten the band, locking the reed in place.

Traditional ligatures have known deficiencies, including slippage, especially with changes in temperature and breath-induced moisture. The thumbscrews may loosen. Over time, the ligature may degrade, for example by stretching or stripping of the threads. Because the ligature encircles the body, as the mouthpiece assembly is mounted on the instrument, or the instrument tuned, the ligature may be displaced or slip.

Because the tonal quality of the woodwind is substantially influenced by the mouthpiece assembly, the ligature affects the tone and resonance of the instrument as a whole.

SUMMARY OF THE INVENTION

The present invention provides a unique configuration for a reed and mouthpiece assembly which when utilized together provide an improved means for the attaching of a reed with respect to a woodwind instrument mouthpiece, and which can easily and quickly be installed. A preferred embodiment of the design does not require use of any special reed, or modifications thereof.

The mouthpiece itself includes a mouthpiece body with an air conduit extending longitudinally therethrough for providing a vibrating air column for the playing of the instrument. A reed placement surface is defined on the mouthpiece body adjacent the air conduit and is adapted to receive a reed detachably secured thereagainst. This reed placement surface is preferably oriented parallel with respect to the air conduit.

The alignment of the reed with the air slot is adjusted according to known techniques. If desired, a slot or groove may be provided in the reed to allow alignment along one or two axes, but this is not required. The reed is adapted to be detachably secured to the reed placement surface adjacent the air conduit of a mouthpiece body to control air flow therethrough. The long axis of the reed is preferably oriented parallel to the longitudinal axis of the air conduit. The reed may be limited in longitudinal movement by a stop at the base of the reed. Further, an adjustable stop may be provided to align the reed, especially where reeds have uniform or known lengths. In general, reeds from various sources do not have identical lengths, and therefore the stop is displaced from the desired end position of the reed, and serves to prevent the reed from slipping far out of position when the retaining pressure is released.

The present invention may be used with any woodwind instrument that uses a single reed system. Tenor, alto and soprano sax, clarinet, bass clarinet, and alto clarinet are just a few examples. This clamp system is designed into the woodwind mouthpiece and holds down the reed to the mouthpiece without the use of a conventional ligature. The clamp is an extension on an otherwise conventional-type mouthpiece, in order to reduce the restraints of the metal band that goes around the circumference of the mouthpiece. The mouthpiece can be made of plastic, rubber or metal, or other materials, as is conventional.

This feature allows the mouthpiece to resonant more freely than a conventional ligature, increasing tone, volume and resonance of the instrument.

A particular aspect of a preferred embodiment of the invention is a sleeve that is incorporated onto the space between the two vertical columns approximately 11/16" apart. Each column has a horizontal channel grooved into it. The clamp is then inserted between the columns in the grooved channels. The reed is slipped under the clamp and a screw with a plastic or metal plate at an end thereof is tightened down onto the reed to secure it in place. As discussed above, a stop may be provided in fixed position to prevent the reed from slipping far beyond its intended position, and thus facilitate preliminary placement of the reed before being clamped in place.

The present invention thus provides one or more radially oriented linear actuators for applying a pressure to hold the reed against the body of the mouthpiece. The linear actuator is, for example a simple helically threaded screw, but may be a more complex design.

In this way, a greater degree of control may be provided over the retention of the reed, as well as the influence over the tonality of the instrument by the reed. By potentially eliminating the effect of the traditional ligature, its damping effect on the tone of the instrument is also potentially eliminated.

A mounting system is provided on the body of the mouthpiece for applying a radial force holding the reed against the body, over the slot. A typical reed has a base with a truncated cylindrical profile, which is beveled toward the tip from the outer cylindrical surface. The edges are also truncated, so that the prepared reed is generally rectangular, ha a defined width, outer surface radius, length, and bevel angle. The tip of the reed may also be contoured to avoid sharp edges. The typical reed doe not have any slots or grooves formed therethrough, and therefore a simple clamp with a threaded protrusion passing through the reed is only an option for modified or non-standard reeds.

On the other hand, a preferred embodiment of the present invention provides laterally oriented mounting columns which straddle the reed, extending from the body of the mouthpiece, and which act under tension in cooperation with a retaining plate, to apply a radial downward force holding the reed in place. The mounting columns are preferably integral to the body of the mouthpiece, which therefore provides a set of lateral shoulders which extend above the thickness of the reed. Advantageously, these mounting columns may be molded as an integral part of the body, and thus have no interfaces which might weaken the structure.

The retaining plate is typically fixed in position by a form-fitting engagement with the vertical columns, for example as a tongue in groove arrangement, or otherwise. The compression of the base of the reed is controlled, for example, by one or more helically threaded elements, a rotation of which allows a controlled application of force. A lever, may also be provided, which can be moved between a free and a clamping position, preferably with a catch to retain the lever in the clamped position unless manually released. Alternately, one or more cams may be provided which have at least a locked and unlocked position, an optionally a means for proportionally controlling a compression of the reed, for example provided on a set of pivotal arms. The compression of the reed may be by direct action of the elements, or through indirect action. For example, in order to evenly distribute the forces on the base of the reed to avoid cracking or warping, a pressure distribution plate, conformed to the outer profile of the reed, may be provided. This pressure distribution plate may be rigid, elastic, or resilient. It is preferably concave, to match the convex shape of the top of a normal reed.

The helically threaded element according to a preferred embodiment preferably will include a knurled external surface extending therearound or wings to further facilitate tightening and loosening thereof with the fingers of the player. For example, a single threaded element or a pair of threaded elements may be provided.

It is an object of the present invention to provide a unique configuration for a reed and mouthpiece assembly for a woodwind instrument, wherein the need for a ligature is eliminated.

It is a further object of the invention to provide a mouthpiece for a woodwind instrument, comprising a body, having an open bore, a reed placement surface proximate to one end of the bore, and a pair of integral extensions situated lateral to the reed placement surface permitting a reed to be placed therebetween; and a reed retention mechanism, adapted to be mounted to the integral extensions, and having a selectively engageable element for applying a substantially normal force to a base of a reed with respect to the reed placement surface, to hold a reed in position over an end of the bore.

It is another object of the invention to provide a mouthpiece assembly for a woodwind musical instrument comprising a mouthpiece body defining an air conduit extending therethrough; a reed placement surface defined on the mouthpiece body adjacent said air conduit; a pair of extensions, integral to and extending from the body of the mouthpiece on opposed sides of the reed placement surface with respect to an opening of the air conduit; and a mechanism for selectively applying a compressive force to a reed placed over the opening of the air conduit, with respect to the body of the mouthpiece, corresponding to a tensile force applied to each of said pair of extensions, to selectively retain the reed in position.

It is a still further object of the invention to provide a mouthpiece for a woodwind instrument, comprising a body, having an open bore, a reed placement surface proximate to one end of the bore; and a reed retention mechanism, having a selectively engageable cam element for selectively applying a substantially normal force to a base of a reed with respect to the reed placement surface, to hold a reed in position over an end of the bore, wherein the cam element has two positions, a first position in which the reed is unlocked and freely removable, a second stable position in which the reed is locked and held in position. The cam element may be designed with a tendency to move toward one of the positions if situated in an intermediate position.

The mouthpiece according to the present invention may further comprise an electronic transducer for producing an electronic output representing an acoustic output of the woodwind instrument. Advantageously, the output of the transducer may be communicated through a wireless transmitter.

An advantageous embodiment of the present mouthpiece design may further comprise an acoustic property modification element, selected from one or more of the group consisting of an acoustic resonator, an acoustic damping element, an acoustic filter, and an element which produces non-linear acoustic distortion. In the later case, the distortion may be provided electronically, for example by an electronic microphone and electronic acoustic emitter, with intermediate electronic circuitry to control the feedback signal, or using a single element, whose acoustic impedance and/or characteristics are controlled.

It is also an object to provide an optional means for aligning a reed along at least one of a lateral and axial direction.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIGS. 1I, 1J, 1K, 1L, 1M, and 1N show, respectively, a side, bottom, cross section, front-top perspective, rear-bottom perspective, and top perspective views of a screw operated pressure plate suitable for use with the embodiment of FIGS. 1A–1H;

DETAILED DESCRIPTION OF THE PREFERRED EMBODIMENT

Figure 1A:
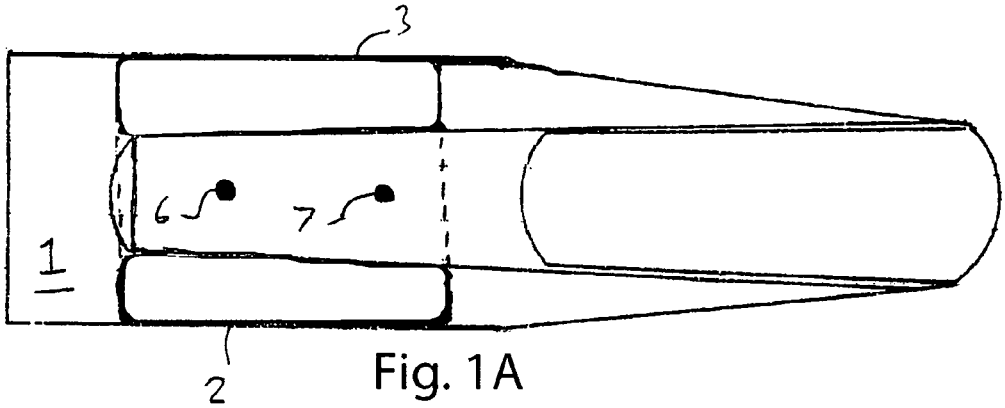
FIGS. 1A, 1B, 1C, 1D, 1E, 1F, 1G, and 1H show, respectively, a top, cross section (with reed compression plate assembly), perspective, bottom, front, back, side and perspective (including a mouthpiece body, pressure plate, reed, and screw) views of first embodiment of the woodwind mouthpiece according to the present invention having a screw operated pressure plate.

FIG. 1A shows a first embodiment of the invention, in which the body 1 of the mouthpiece has a pair of vertical columns 2, 3, which extend from the lower side of the body 1, at the based of the reed 4. A retention plate 5 is held in fixed position by the pair of vertical columns 2, 3 over the base of the reed 4. A pair of screws 6, 7 are threaded through the retention plate 4, and apply a direct radial force on the reed. As shown in FIGS. 1H–1N, a single screw may also be used. The tip of the screw(s) may have a conformal plate or other structure, not shown in FIGS. 1A and 1B, but shown in FIGS. 1I–1N, to distribute the applied forces over the base of the reed 4.

The mouthpiece 1 preferably has a stop 40 slightly beyond the end of a normal reed, which defines a constrained space for inserting the reed, while being prevented from falling out the back. It is also possible to precisely align this stop to perfectly position the reed; however, due to manufacturing and style variations in reeds, an adjustment of this stop position would generally be necessary.

Figure 2A:
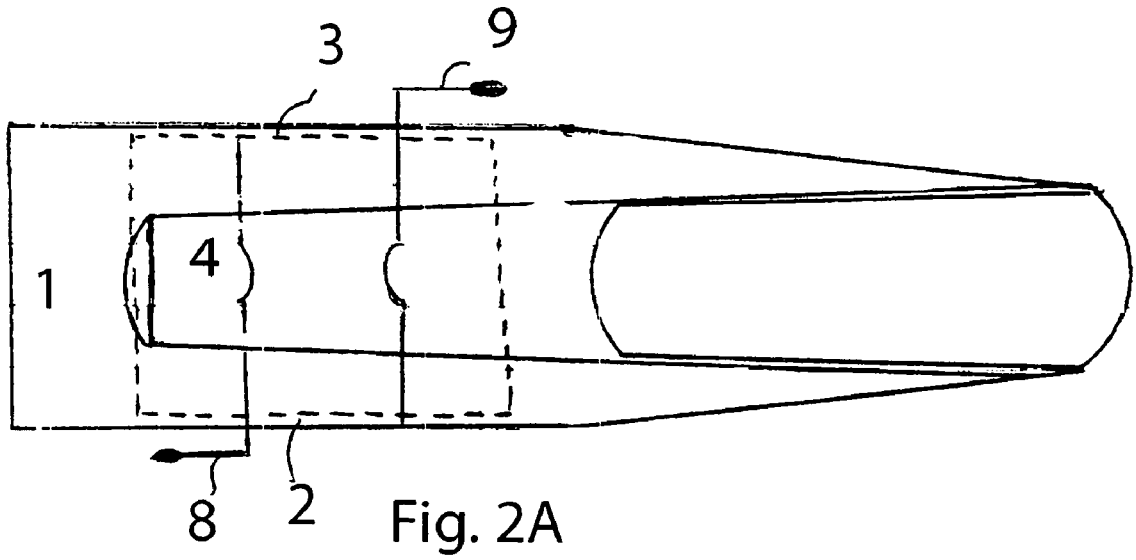
FIGS. 2A and 2B show, respectively, a top and cross section view of a semischematic illustration of a second embodiment of the woodwind mouthpiece according to the present invention having a lever operated pressure plate.
Figure 2B:
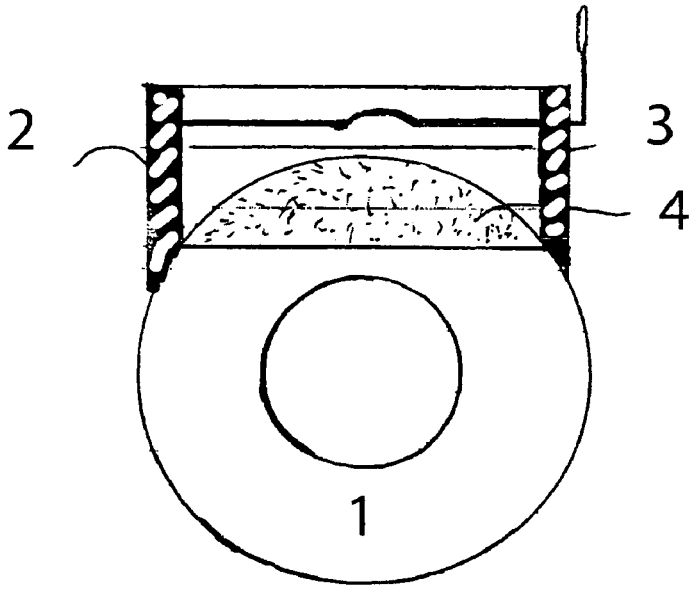

FIGS. 2A and 2B show a second embodiment of the invention, in which the retention plate 5 and pair of screws 6, 7 are replaced with a pair of cam actuators 8, 9. The cam actuators 8, 9 are affixed directly to the vertical columns 2, 3, and can be adjusted to achieve a desired radial force on the base of the reed 4.

Figure 1B:
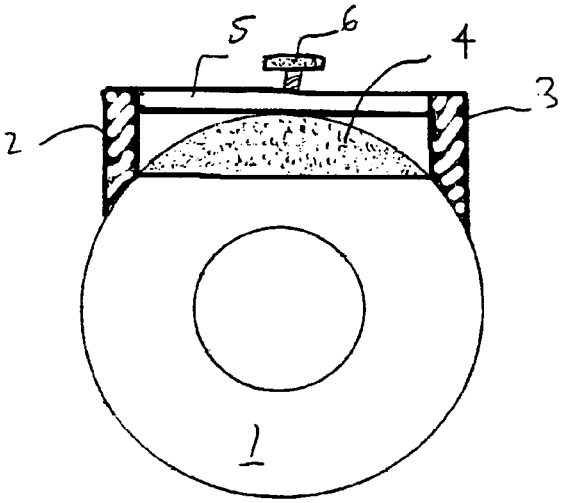
Figure 1H:
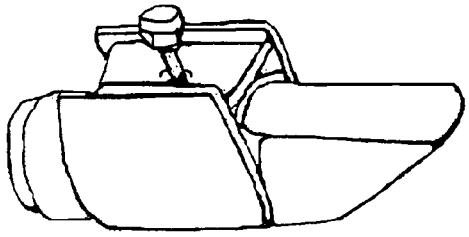
Figure 1E:
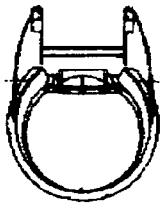
Figure 1G:
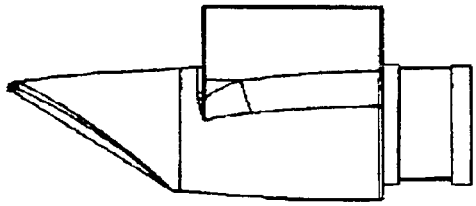
Figure 1F:
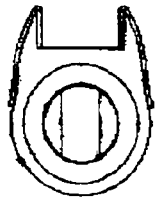
Figure 1D:
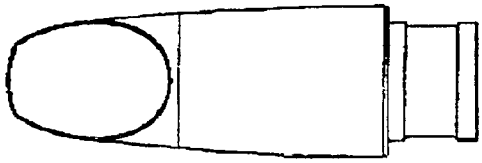
Figure 1C:
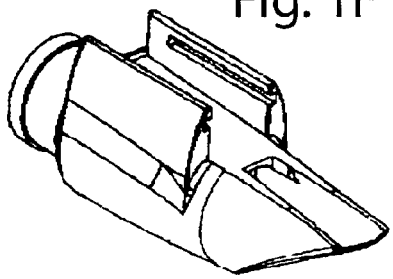
Figure 3A:
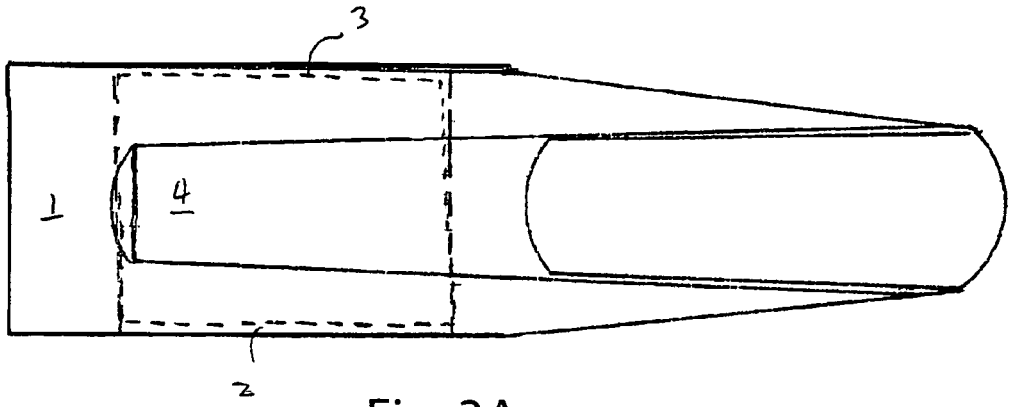
FIGS. 3A, 3B, 3C, and 3D show, respectively, a top view, end view (prior to grooving), end view (with grooves), and retaining plate, screw and distribution plate detail, of the first embodiment of the woodwind mouthpiece according to an embodiment of the present invention.
Figure 3B:
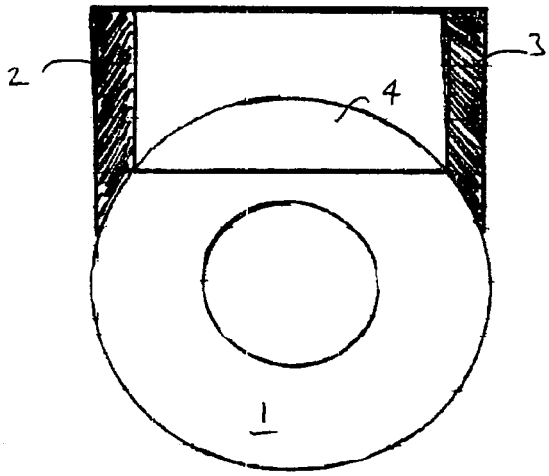
Figure 3C:
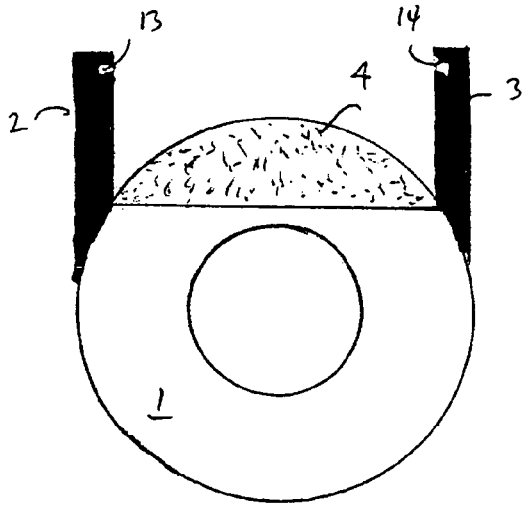
Figure 3D:
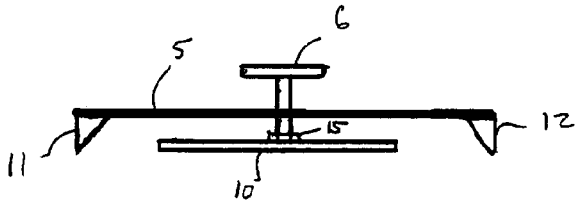

FIGS. 3A, 3B, 3C, and 3D show a slight variation on the embodiment of FIGS. 1A, 1B and 1C. In this case, the vertical columns 2, 3 are channeled with grooves 13, 14, as shown in FIG. 3C. The retention plate 5 has complementary tongues 11, 12 which conform to the shape of the grooves 13, 14, allowing it to be removed. FIG. 3D shows the conformal plate 10, which is adjusted by the action of screw 6 to apply a varying pressure on the base of the reed 4. The screw 6 is connected to the conformal plate 10 by a bearing 15.

FIGS. 4A, 4B, 4C, and 4D show an embodiment similar to that shown in FIGS. 3A, 3B, 3C, and 3D. In this case, a knurled disk 24, having a center threaded hole for threaded rod 25, is rotated to control a pressure between the conformal plate 28 and the retention plate 29, which in turn is held in place by the vertical columns 22, 23, which have a lateral aperture 30 allowing access to the knurled disk 24 for rotation thereof. The retention plate 29 has clips 26, 27, which interlock with channels 31, 32 on the vertical columns 22, 23.

Figure 4C:
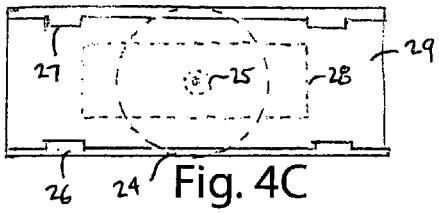
FIGS. 4A, 4B, 4C and 4D show, respectively, a top view (body only), and side view (assembly), a top view of retaining plate, screw and distribution plate detail, and a side view of a retaining plate, screw and distribution plate detail, of a third embodiment according to the present invention.
Figure 4A:
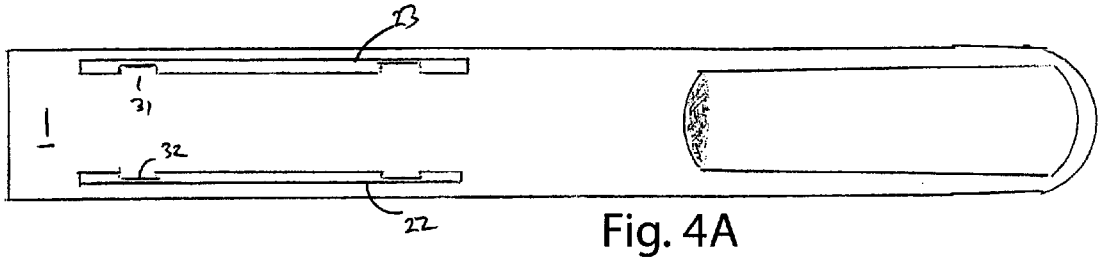
Figure 4B:
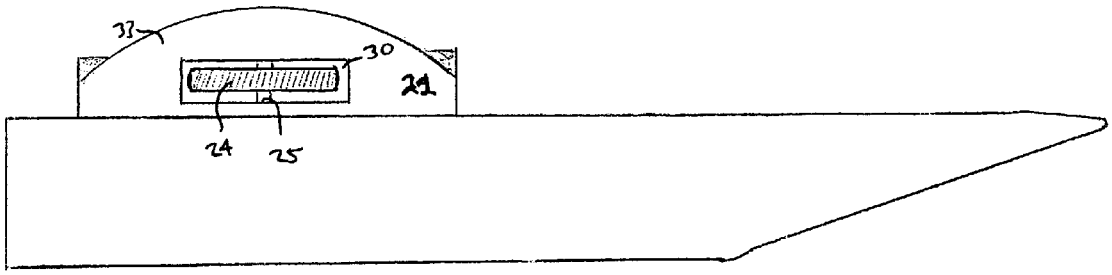
Figure 4D:
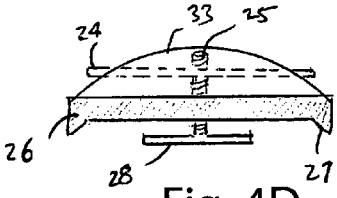

FIGS. 4C and 4D show a dome 33 over the reed clamping mechanism. A microphonic pickup may be provided in or in conjunction with this dome to sense the acoustical emissions or vibrations of the reed.

Figure 5:
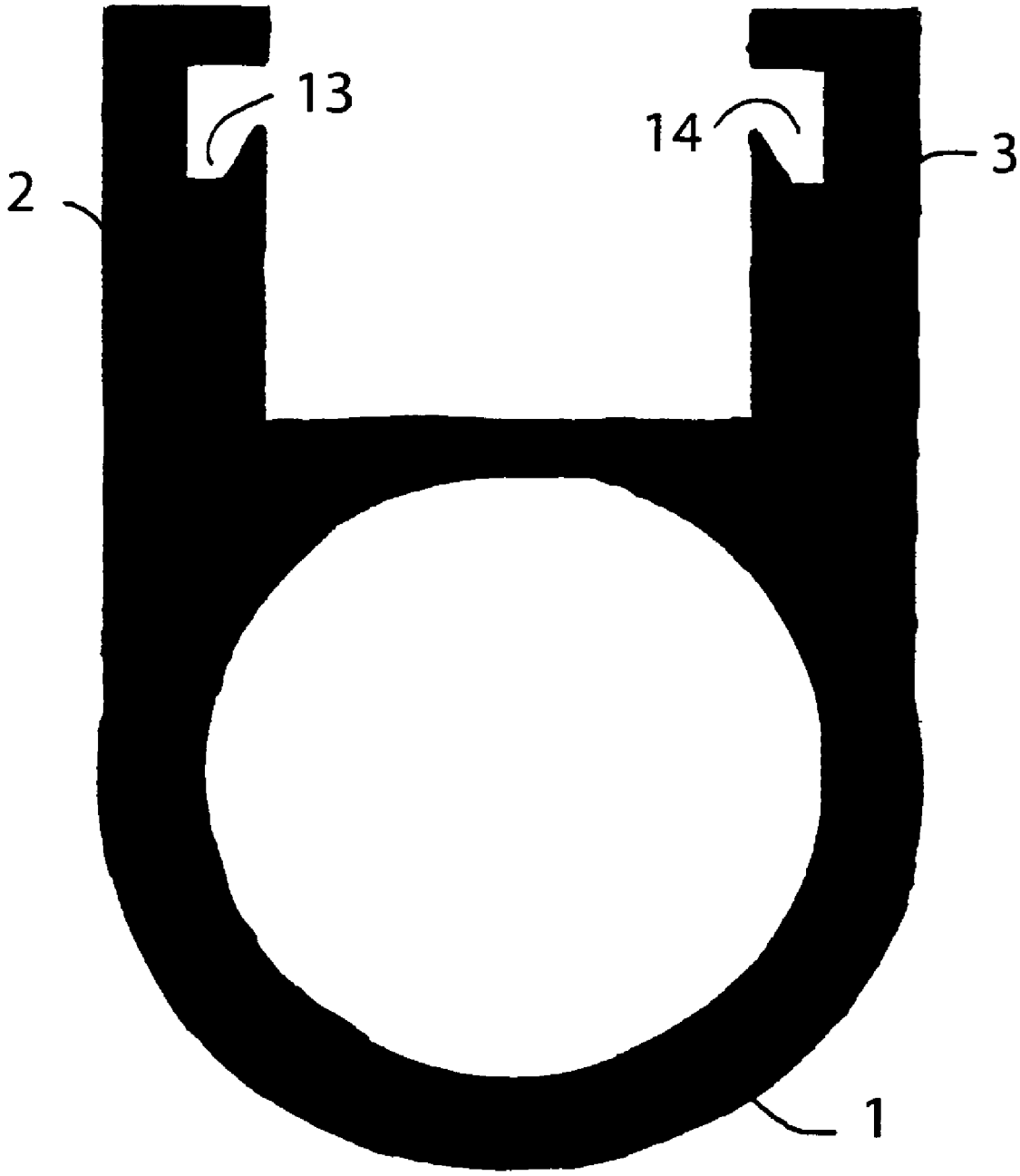
FIG. 5 is cross section view with dimensions of a saxophone mouthpiece body, similar to the design of FIG. 3C.

FIG. 5 shows a cross section of the body 1, for example similar to FIG. 3C, showing particular dimensions suitable for a saxophone.

In use, in order to replace a reed, the user will first rotate the tightening knob 24 by gripping of the knurled external surface thereof in, for example, a counterclockwise direction for loosening. This will loosen the engagement between the conformal plate 28 and the base of the reed 4 therebelow. The musician can then move the reed. Once removed, a new reed can then be inserted below the conformal plate 28. Once the reed is in full proper position the tightening knob 24 can be rotated in, for example, a clockwise direction to exert pressure downwardly on the conformal plate 28 which in turn will exert downward pressure upon the base of the reed 4 positioned between the vertical columns 22, 23. Thus a rapid and efficient means is provided for quickly and conveniently replacing of a reed for a woodwind instrument mouthpiece. Advantageously, the inner walls of the vertical columns 22, 23 are so spaced as to align the base of a standard reed therebetween. Thus, assured axial alignment is possible. Further, not shown in the drawings, the end of the base may abut a shoulder on the body of the mouthpiece, making longitudinal alignment also possible. If required, the body of the mouthpiece may be provided with adjustments to allow the player to refine the placement of the reed, for example by vernier adjustments or shims.

In conjunction with the conformal plate, in between the vertical columns, or inside the bore of the mouthpiece, it is possible to provide elements which modify the acoustic properties of the instrument. These may be simple mechanical resonators, dampers and/or filters, or electronic devices including microphones, emitters, electronically controlled elements having variable acoustic impedance and/or active acoustic properties, and the like.

For example, it is possible to generate higher order harmonics by modifying the acoustic waveform in an amplitude-dependent manner, similar to the electronic controls applied to guitars. However, since these modifications may be made in real time to the overtones generated by the instrument, the instrument will not be dependent on an electronic amplification system for output. Likewise, the power consumption will be generally reduced as compared to an electronic output instrument. For example, a piezoelectric material may be provided adjacent to the reed or within the bore of the mouthpiece. A suitable material may be, for example, a piezoelectric ceramic or polyvidinylene fluoride (PVDF). It is noted that electromagnetic transducers may also be used.

As the reed vibrates, an electrical signal is transduced into the piezoelectric material. If the piezoelectric material is not externally coupled, little power will be drawn from the system, and the acoustic pattern will be generally unmodified. On the other hand, if the electrical signal is attenuated, the vibration will be damped. Since the damping network may be completely controlled, a full range of variations is possible, as known in the art of active filtering and acoustic signal processing systems. It is further noted that the system is not particularly limited to passive damping, and therefore it is possible for the piezoelectric transducer, under some or all circumstances, to actively generate vibrations or vibrational energy with a desired waveform.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

What is claimed is:

1. A mouthpiece for a woodwind instrument, comprising:

(a) a body, having an open bore, a reed placement surface proximate to one end of the bore, and a pair of extensions integrally formed therewith and to the reed placement surface permitting a reed to be placed therebetween; and (b) a reed retention mechanism, adapted to be mounted to the integral extensions, and having a selectively engageable element for applying a substantially normal force to a base of a reed with respect to the reed placement surface, to hold a reed in position over an end of the bore.

2. The mouthpiece according to claim 1, further comprising an electronic transducer for producing an electronic output representing an acoustic output of the woodwind instrument.

3. The mouthpiece according to claim 2, further comprising a wireless transmitter for communicating said electronic output external to the woodwind instrument.

4. The mouthpiece according to claim 1, further comprising an acoustic property modification element, selected from one or more of the group consisting of an acoustic resonator, an acoustic damping element, an acoustic filter, and an element which produces non-linear acoustic distortion.

5. The mouthpiece according to claim 1, further comprising an element for aligning a reed along at least one of a lateral and axial direction.

6. A mouthpiece assembly for a woodwind musical instrument comprising:

a mouthpiece body defining an air conduit extending therethrough;

a reed placement surface defined on the mouthpiece body adjacent said air conduit; and a pair of extensions, formed integrally with and extending from the body of the mouthpiece on laterally opposed sides of the reed placement surface with respect to an opening of the air conduit, said extensions being adapted to support a clamp for applying a compressive force between a reed and said reed placement surface.

7. The mouthpiece according to claim 6, further comprising a mechanism for selectively applying a compressive force to a reed placed over the opening of the air conduit, with respect to the body of the mouthpiece, resulting from a tensile force applied to said pair of extensions.

8. The mouthpiece according to claim 6, wherein the reed placement surface has a wall protruding therefrom to resist a sliding of the reed along a longitudinal axis of the mouthpiece.

9. The mouthpiece according to claim 6, further comprising an electronic transducer for producing an electronic output representing an acoustic output of the woodwind instrument.

10. The mouthpiece according to claim 9, further comprising a wireless transmitted for communicating said electronic output external to the woodwind instrument.

11. The mouthpiece according to claim 6, further comprising an acoustic property modification element, selected from one or more of the group consisting of an acoustic resonator, an acoustic damping element, an acoustic filter, and an element which produces non-linear acoustic distortion.

12. The mouthpiece according to claim 6, further comprising an element for aligning a reed along at least one of a lateral and axial direction.

* * * * *